United States Patent [19]

Heil

[11] 4,161,268

[45] * Jul. 17, 1979

[54] SKI STORING, PROTECTING, AND CARRYING APPARATUS

[76] Inventor: Charles W. Heil, 1629 Hickory La., Eagan, Minn. 55122

[ * ] Notice: The portion of the term of this patent subsequent to Nov. 25, 1992, has been disclaimed.

[21] Appl. No.: 711,848

[22] Filed: Aug. 5, 1976

[51] Int. Cl.[2] ..... B65D 7/24; A63C 11/02

[52] U.S. Cl. ..... 224/45 S; 220/8; 190/45

[58] Field of Search ..... 224/45 R, 45 S, 2 A, 224/5 Z, 46 R, 47, 42.42; 190/44, 45; 150/52; 220/8; 70/58; 280/11.37 K, 11.37 A, 11.37 C

[56] References Cited

U.S. PATENT DOCUMENTS

| | | | |
|---|---|---|---|
| 2,234,487 | 3/1941 | Davis | 280/11.37 C |
| 2,250,388 | 7/1941 | Mickelberg | 280/11.37 K |
| 3,744,687 | 7/1973 | Oreck | 220/8 X |
| 3,767,036 | 10/1973 | McLeod | 224/45 S X |
| 3,921,871 | 11/1975 | Heil | 224/45 S |

FOREIGN PATENT DOCUMENTS

| | | | |
|---|---|---|---|
| 2132731 | 1/1973 | Fed. Rep. of Germany | 224/45 S |

*Primary Examiner*—Francis S. Husar
*Assistant Examiner*—D. W. Underwood
*Attorney, Agent, or Firm*—Wicks & Nemer

[57] ABSTRACT

Apparatus for storing, protecting, and carrying first and second snow skis having their bottom surfaces placed adjacent to each other is disclosed, in the preferred embodiment, as a container. The container is thin-walled, elongated, and hollow and includes container portions arranged in a telescopic relation. The preferred three portions of the container can also be locked at any of several desired step locations intended to conform to differing length skis. First and second snow skis are removably captured within the interior of the container first by a protrusion formed integrally with a closed end of one of the container portions which engages and holds the ends of the skis, second by a sloped bottom surface formed integral with the closed end of another container portion which urges the ski tips upward, and third by a depression in the ski case. In the preferred embodiment, the depression comprises the cut out hand grip area beneath the handle of the container which limits the upward movement of the skis.

27 Claims, 7 Drawing Figures

SKI STORING, PROTECTING, AND CARRYING APPARATUS

BACKGROUND

The present invention relates generally to apparatus for storing, protecting, and carrying and more specifically to apparatus for storing, protecting, and carrying first and second snow skis.

With the increasing interest in skiing, an increasing need has arisen for apparatus for transporting ski equipment which prevents damage to the ski equipment during transit or handling, especially during transit by air or rail. Such apparatus should be light in weight allowing inexpensive shipment thereof, small, easy to carry without large expenditures of energy, and able to accommodate several length of skis. Further, such apparatus should protect the skis from external forces such as accidentally dropping the apparatus or dropping other items such as luggage on the apparatus and should prevent the skis from bouncing or moving within the apparatus.

SUMMARY

The apparatus of the present invention solves these and other problems in apparatus for storing, protecting, and carrying skis by providing, in the preferred embodiment, a rigid, hollow, thin-walled, elongated container having a first closed end and a second closed end and divided into a first container portion and a second container portion in a telescopic relation. The container further includes means for telescopically capturing a first snow ski and a second snow ski in the interior of the container and for allowing the container to be used for several differing lengths of skis.

It is thus a primary object of the present invention to provide novel ski storing, protecting, and carrying apparatus.

It is a further object of the present invention to provide such novel apparatus for storing, protecting, and carrying a first and a second snow ski.

It is a further object of the present invention to provide such novel ski storing, protecting, and carrying apparatus which is small in size, easy to carry, and light in weight.

It is a further object of the present invention to provide such novel storing, protecting, and carrying apparatus which telescopically captures skis therein to prevent skis from bouncing or otherwise moving within the container during transit to thus avoid damage.

It is a further object of the present invention to provide such novel storing, protecting, and carrying apparatus which protects skis from external forces applied to the container.

It is a further object of the present invention to provide such novel storing, protecting, and carrying apparatus which protects ski equipment during handling thereof.

It is a further object of the present invention to provide such novel storing, protecting, and carrying apparatus which can be used on several lengths of skis.

It is a further object of the present invention to provide such novel ski storing, protecting, and carrying apparatus which is simple in design, easy to manufacture, and which maximizes the materials used.

These and further objects and advantages of the present invention will become clearer in the light of the following detailed description of an illustrative embodiment of this invention described in connection with the drawings.

DESCRIPTION

The present invention relates generally to improvements in the ski storing, protecting, and carrying apparatus as shown and described in U.S. Pat. No. 3,921,871 issued on Nov. 25, 1975 in the name of the present inventor. Application Ser. No. 532,892 filed Dec. 16, 1974 by Charles W. Heil entitled Ski Storing, Protecting, and Carrying Apparatus, now U.S. Pat. No. 3,921,871 is incorporated by reference to augment the disclosure of the present invention. Generally, the present invention relates to an alternate method of limiting movement of the first and second snow ski in a direction opposite to the latitudinal direction which the first and second snow skis are urged by the bottom surface 144 of apparatus 10.

Figures 1, 5, 6, 7:
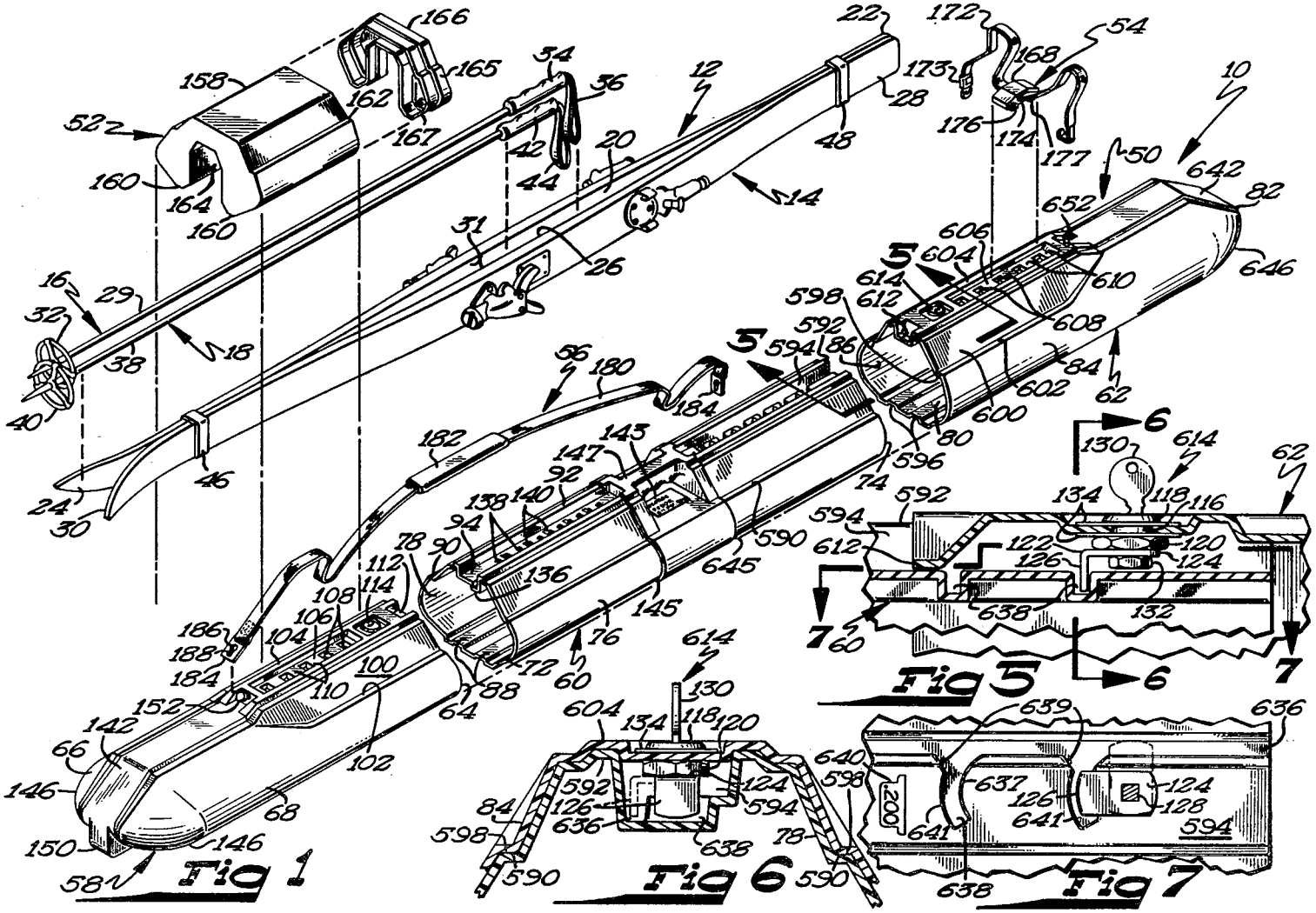
FIG. 1 shows an exploded perspective view of a ski storing, protecting, and carrying apparatus according to the present invention, in association with snow skis and ski poles to be stored.
FIG. 5 is a cross sectional view of the apparatus of FIG. 1 according to section line 5—5 of FIG. 1 with the container telescoped together.
FIG. 6 is a fragmentary cross sectional view of the apparatus of FIG. 1 according to section line 6—6 in FIG. 5.
FIG. 7 is a fragmentary cross sectional view of the apparatus of FIG. 1 according to section line 7—7 in FIG. 5.
Figure 2:
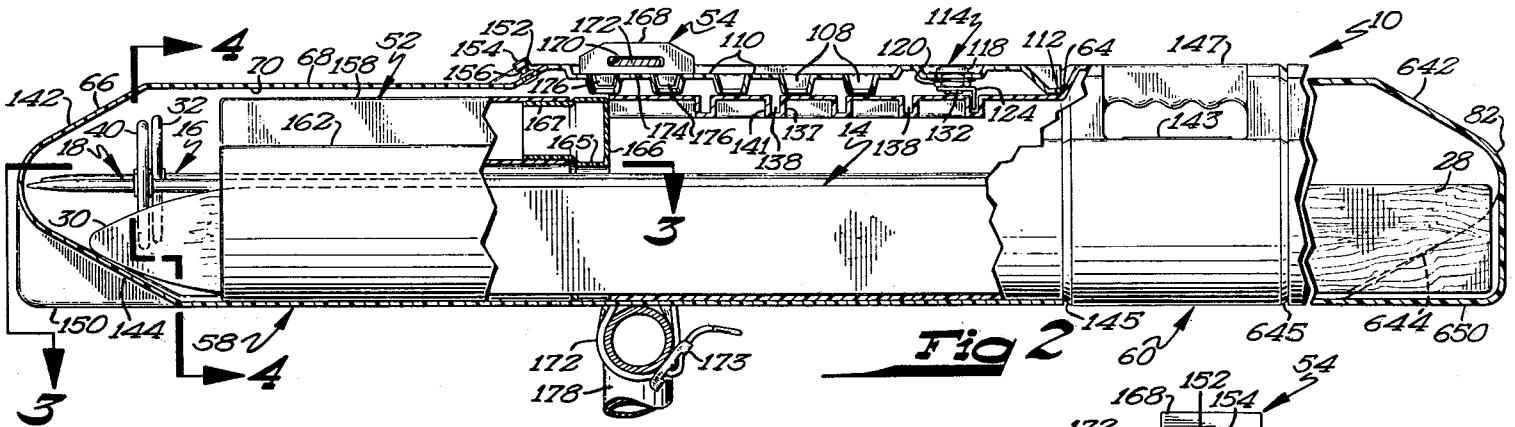
FIG. 2 is a side view of the apparatus of FIG. 1 with portions of the apparatus broken away.
Figure 4:
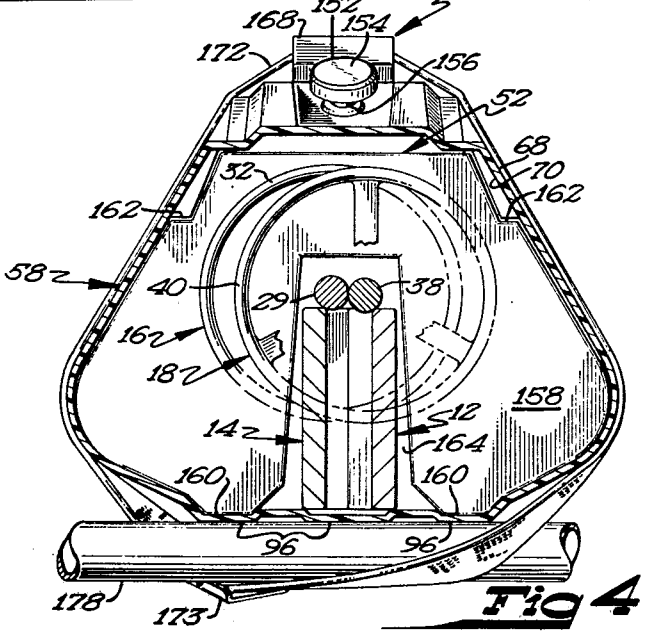
FIG. 4 is a cross sectional view of the apparatus of FIG. 1 according to section line 4—4 of FIG. 2.
Figure 3:
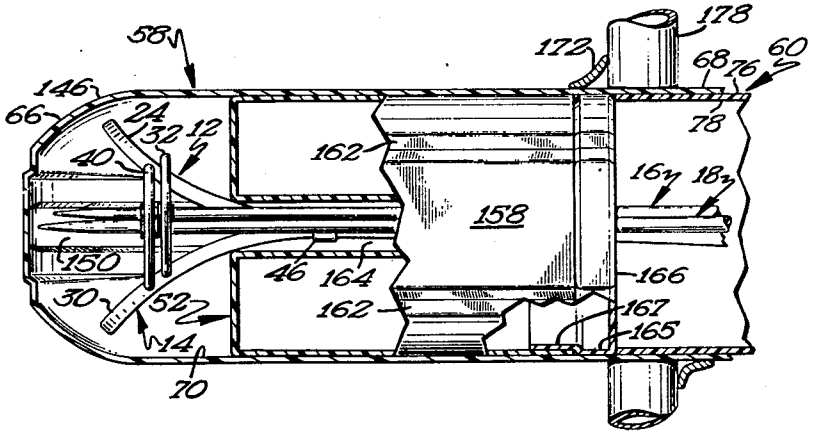
FIG. 3 is a partial longitudinal cross sectional view of the apparatus of FIG. 1 according to section line 3—3 of FIG. 2.

As best seen in FIGS. 1 and 2 and as described in U.S. Pat. No. 3,921,871 at least at column 4, lines 48–57, second container portion 60 includes a limiting member integrally formed with container 50, shown by the cut out hand grip area beneath handle 147 upon which ownership indicating member 143 is provided. It has been found that this limiting member can limit the movement of the first and second snow skis in a manner analogous to that of saddle 52 described herein.

For the sake of example, it will be assumed that skis 12 and 14 are located within second and third container portions 60 and 62, respectively, following the procedure as set forth in U.S. Pat. No. 3,921,871. Specifically, it has been found that, if saddle 52 is not used, as first container portion 58 is telescoped on second container portion 60, ski tips 24 and 30 will engage inclined cam bottom surface 144. After further movement, tips 24 and 30 will ride on inclined bottom surface 144 thus camming ski tips 24 and 30 vertically upward. As tips 24 and 30 ride on inclined bottom surface 144, inclined bottom surface 144 urges ski tip 24 of first ski 12 in a latitudinal direction perpendicular to the longitudinal axis of container 50 and inclined bottom surface 144 urges ski tip 30 of second ski 14 in a latitudinal direction perpendicular to the longitudinal axis of container 50. Therefore, inclined bottom surface 144 urges snow skis 12 and 14 vertically upward.

However, as previously explained, it has been found that the limiting member, as defined by the cut out hand grip area beneath handle 147 upon which ownership indicating member 143 is provided, likewise, limits the movement of first snow ski 12 in a direction opposite to the latitudinal direction urges by inclined bottom surface 144 and also limits the movement of second snow ski 14 in a direction opposite to the latitudinal direction urged by inclined bottom surface 144. Therefore, it has been found that the forward portions of skis 12 and 14 are placed under slight pressure by the limiting member, as defined by the cut out hand grip area beneath handle 147 upon which ownership indicating member 143 is provided, and inclined surface 144 to prevent latitudinal movement in a direction perpendicular to the longitudinal axis of container 50. Further, ski ends 22 and 28 are located within protrusion 150, thus also preventing latitudinal movement in a direction perpendicular to the longitudinal axis of container 50. Still further, skis 12 and 14 are also prevented from moving in a direction parallel to the longitudinal axis of container 50 due to the telescopically capturing of skis between protrusion 150 of closed end 82 of third container portion 62 and inclined bottom surface 144 of first container portion 58 together with the limiting member, as defined by the cut out hand grip area beneath handle 147 upon which ownership indicating member 143 is provided. Skis 12 and 14 are then removably captured within container 50 to prevent skis 12 and 14 from bouncing, rattling, or moving inside container 50 during transit.

It should be noted that ski tips 24 and 30 of skis 12 and 14 may ride up farther on bottom surface 144 when skis 12 and 14 abut against the limiting member, as defined by the cut out hand grip area beneath handle 147 upon which ownership indicating member 143 is provided, than they do when saddle 52 is used in that the location of the limiting member, shown, is farther away from tips 24 and 30 of skis 12 and 14 than the location of saddle 52 if it were to be used as explained in U.S. Pat. No. 3,921,871. This may not necessarily be the case, however, with adjustment of dimensions.

Now that the basic teachings of the present invention have been explained, many extensions and variations will be obvious to one having ordinary skill in the art. For example, although limiting member, in the preferred embodiment, is shown as being defined by the cut out hand grip area beneath handle 147, it would be obvious to persons skilled in the art to form limiting member elsewhere within container 50 including in portions 58, 60, and 62, with or without handle 147 and/or with or without the cut out area as shown.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

I claim:

1. Apparatus for storing, protecting, and carrying a first snow ski and a second snow ski with the first ski having a bottom surface, an end, two sides, and a tip formed on the forward portion of the snow ski and curved from the bottom surface and with the second ski having a bottom surface, an end, two sides, and a tip formed on the forward portion of the snow ski and curved from the bottom surface with the bottom surface of the first ski adjacent to and facing the bottom surface of the second ski, comprising, in combination: a rigid, hollow, thin-walled elongated container having a first closed end and a second closed end spaced from the first closed end, with the container also including at least a first portion and a second portion being in a telescopic relation; and means for telescopically capturing the first and second snow skis within the container when the second portion is telescoped with the first portion to prevent longitudinal movement of the first and second snow skis within the container and for allowing the container to be used for several length of skis, comprising: first means for engaging and holding the end of the first snow ski; second means for engaging and holding the end of the second snow ski; and third means for retaining the tip of the first snow ski and the tip of the second snow ski to prevent latitudinal movement in a direction perpendicular to the longitudinal axis of the container and for centrally aligning the forward portions of the first and second snow skis within the container when the second portion is telescoped with the first portion comprising: fourth means for urging the tip of the first snow ski in a latitudinal direction perpendicular to the longitudinal axis of the container; fifth means for urging the tip of the second snow ski in a latitudinal direction perpendicular to the longitudinal axis of the container; sixth means for limiting movement of the first snow ski in a direction opposite to the latitudinal direction which the first snow ski is urged by the fourth urging means; and seventh means for limiting movement of the second snow ski in a direction opposite to the latitudinal direction which the second snow ski is urged by the fifth urging means, with the sixth and seventh means comprising a limiting member formed integrally with the container against which one side of each of the first and second snow ski abut to thereby removably capture the first and second snow skis within the container when the second portion is telescoped with the first portion to prevent the skis from bouncing, rattling, or moving inside the container during transit.

2. The apparatus of claim 1 wherein the container further includes a handle, with the limiting member being defined by a cut out hand grip area located beneath the handle.

3. The apparatus of claim 1 wherein the fourth means comprises an inclined cam surface integral with one of the closed ends of the container on which the tip of the first snow ski rides when the second portion is telescoped with the first portion and wherein the fifth means comprises an inclined cam surface integral with one of the closed ends of the container on which the tip of the second snow ski rides when the second portion is telescoped with the first portion.

4. The apparatus of claim 3 wherein the first means comprises a protrusion formed on and integral with one of the closed ends for receiving the end of the first snow ski and wherein the second means comprises a protrusion formed on and integral with one of the closed ends for receiving the end of the second snow ski such that the ends of the skis are captured within and retained within the protrusions.

5. The apparatus of claim 4 wherein the container further includes a third container portion; and wherein the second container portion includes a first open end, a second open end, a right half, and a left half; the first container portion includes an open end and the first closed end; the third container portion includes an open end and the second closed end with the first and third container portions being in a telescopic relation with the second container portion.

6. The apparatus of claim 5 wherein the first container portion is identical to the third container portion and the right half of second container portion is a reverse mirror image of the left half of second container portion allowing the interchangement of the first container portion with the third container portion in the telescopic relation with the second container portion.

7. The apparatus of claim 3 wherein the first, second, fourth, and fifth means are formed on both the first and second closed ends.

8. The apparatus of claim 3 wherein the fourth and the fifth means are located on the same closed end.

9. The apparatus of claim 1 wherein the container further includes a third container portion; and wherein the second container portion includes a first open end, a second open end, a right half, and a left half; the first container portion includes an open end and the first closed end; the third container portion includes an open end and the second closed end with the first and third container portions being in a telescopic relation with the second container portion.

10. The apparatus of claim 9 wherein the first container portion is identical to the third container portion and the right half of second container portion is a reverse mirror image of the left half of second container portion allowing the interchangement of the first container portion with the third container portion in the telescopic relation with the second container portion.

11. The apparatus of claim 1 wherein the second container portion further includes rails formed on the outside top and bottom surfaces and the first container portion further includes slides formed on the inside top and bottom surfaces adapted to slide along and are captured along the rails when the first portion is telescoped on the second portion.

12. The apparatus of claim 1 wherein the first means comprises a protrusion formed on and integral with one of the closed ends for receiving the end of the first snow ski and wherein the second means comprises a protrusion formed on and integral with one of the closed ends for receiving the end of the second snow ski such that the ends of the skis are captured within and retained within the protrusions.

13. The apparatus of claim 1 wherein the first means and the second means are located on the same closed end.

14. The apparatus of claim 2 wherein the fourth means comprises an inclined cam surface integral with one of the closed ends of the container on which the tip of the first snow ski rides when the second portion is telescoped with the first portion and wherein the fifth means comprises an inclined cam surface integral with one of the closed ends of the container on which the tip of the second snow ski rides when the second portion is telescoped with the first portion.

15. The apparatus of claim 14 wherein the first, second, fourth, and fifth means are formed on both the first and second closed ends.

16. The apparatus of claim 14 wherein the fourth and the fifth means are located on the same closed end.

17. The apparatus of claim 2 wherein the first means comprises a protrusion formed on and integral with one of the closed ends for receiving the end of the first snow ski and wherein the second means comprises a protrusion formed on and integral with one of the closed ends for receiving the end of the second snow ski such that the ends of the skis are captured within and retained within the protrusions.

18. The apparatus of claim 2 wherein the container further includes a third container portion; and wherein the second container portion includes a first open end, a second open end, a right half, and a left half; the first container portion includes an open end and the first closed end; the third container portion includes an open end and the second closed end with the first and third container portions being in a telescopic relation with the second container portion.

19. The apparatus of claim 18 wherein the first container portion is identical to the third container portion and the right half of second container portion is a reverse mirror image of the left half of second container portion allowing the interchangement of the first container portion with the third container portion in the telescopic relation with the second container portion.

20. The apparatus of claim 2 wherein the second container portion further includes rails formed on the outside top and bottom surfaces and the first container portion further includes slides formed on the inside top and bottom surfaces adapted to slide along and are captured along the rails when the first portion is telescoped on the second portion.

21. The apparatus of claim 2 wherein the first means and the second means are located on the same closed end.

22. The apparatus of claim 1 wherein the container can be used on skis varying in length from 160 centimeters to 200 centimeters (63 inches to 79 inches).

23. The apparatus of claim 22 wherein the container further includes a third container portion; and wherein the second container portion includes a first open end, a second open end, a right half, and a left half; the first container portion includes an open end and the first closed end; the third container portion includes an open end and the second closed end with the first and third container portions being in a telescopic relation with the second container portion.

24. The apparatus of claim 23 wherein the total length of the first and third container portions is approximately 29.50 inches (75 centimeters) each and wherein the total length of the second container portion is approximately 32.38 inches (82 centimeters).

25. The apparatus of claim 24 wherein the total length that the first and third container portions can telescope on the second container portion is approximately equal to 13 inches (33 centimeters).

26. The apparatus of claim 12 wherein the total width of the protrusions forming the first and second means is approximately equal to but slightly larger than twice the thickness of the skis.

27. The apparatus of claim 26 wherein the total width of the protrusions forming the first and second means is approximately equal to 1.32 inches (3.4 centimeters).

* * * * *